US005380174A

United States Patent [19]

Schwing

[11] Patent Number: 5,380,174

[45] Date of Patent: Jan. 10, 1995

[54] PUMP FOR THICK MATTER HAVING DELIVERY CYLINDERS, IN PARTICULAR A TWO-CYLINDER CONCRETE PUMP

[75] Inventor: Friedrich Schwing, Gelsenkirchen, Germany

[73] Assignee: Friedrich Wilh. Schwing GmbH, Herne, Germany

[21] Appl. No.: 35,431

[22] Filed: Mar. 24, 1993

[30] Foreign Application Priority Data

Mar. 24, 1992 [DE] Germany ..... 4209471.2

[51] Int. Cl.[6] ..... F04B 15/02

[52] U.S. Cl. ..... 417/519; 417/900; 417/532

[58] Field of Search ..... 417/900, 512, 517, 519, 417/532

[56] References Cited

U.S. PATENT DOCUMENTS

| | | | |
|---|---|---|---|
| 3,920,357 | 11/1975 | Taylor | 417/900 |
| 4,057,373 | 11/1977 | Schwing | 417/519 |
| 4,178,142 | 12/1979 | Schwing | 417/900 |
| 4,343,598 | 8/1982 | Schwing et al. | 417/517 |
| 4,373,875 | 2/1983 | Schwing | 417/517 |
| 4,563,135 | 1/1986 | Riker | 417/517 |
| 4,653,990 | 3/1987 | Schlecht | 417/517 |

FOREIGN PATENT DOCUMENTS

| | | | |
|---|---|---|---|
| 0016410 | 10/1980 | European Pat. Off. . | |
| 0024343 | 3/1981 | European Pat. Off. . | |
| 2282546 | 3/1976 | France . | |
| 1214842 | 12/1970 | United Kingdom | 417/517 |
| 1585794 | 3/1981 | United Kingdom | 417/517 |

*Primary Examiner*—Richard A. Bertsch
*Assistant Examiner*—Peter Korytnyk
*Attorney, Agent, or Firm*—Kinney & Lange

[57] ABSTRACT

In a pump for thick matter with delivery cylinders (1, 2), in particular a two-cylinder concrete pump, which in order to control the flow of thick matter, incorporates a distributing regulator (11) that is connected permanently at an outlet opening (8) with the pump-side end (9) of a delivery line (7) and which incorporates at least one inlet opening (12) where it is sealed on the web (29) between the thick-matter flow passage openings (16, 17) from the delivery cylinders into a supply tank (6), the thick-matter flow passage openings (16, 17) and the inlet opening (12) of the distributing regulator (11) being of identical outline and area, the distributing regulator (11) connecting adjacent thick matter flow passage openings (16, 17) alternately with the delivery line (7) and the supply tank (6) by a rotating movement, the present invention provides for the fact that the thick-matter flow passage openings (16, 17) together with their associated delivery cylinder openings (22, 23) are each connected through a standoff pipe (24, 25), and the inside diameters of the flow passage openings (16, 17) that are formed by the standoff pipes (24, 25) are reduced on the web (29), the reduction in the diameter in the distributing regulator inlet opening (12) being matched to the web (29) (FIG. 1).

9 Claims, 4 Drawing Sheets

Figure 1:
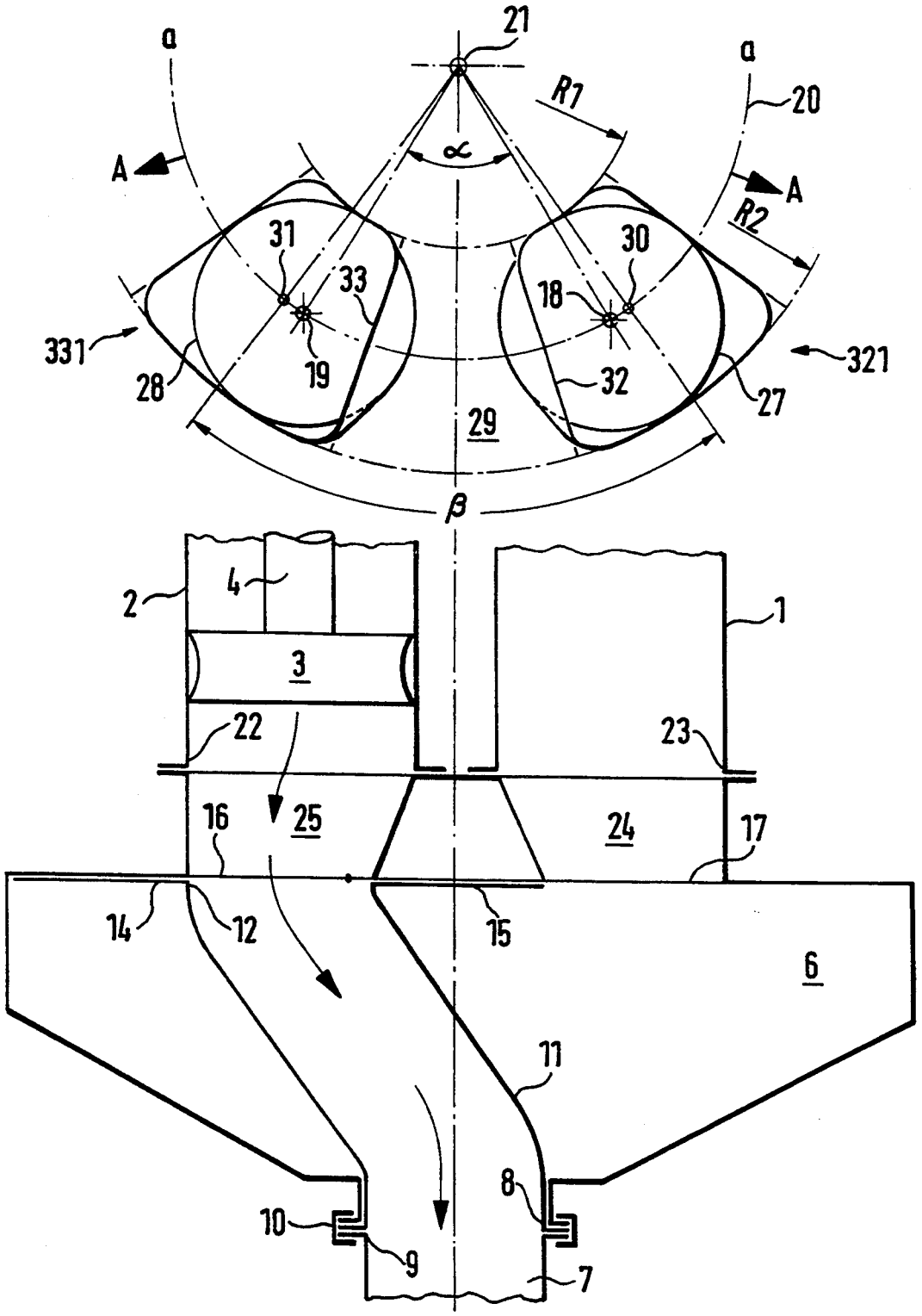

PUMP FOR THICK MATTER HAVING DELIVERY CYLINDERS, IN PARTICULAR A TWO-CYLINDER CONCRETE PUMP

DESCRIPTION

The present invention relates to a pump for thick matter, this pump having delivery cylinders, in particular a two-cylinder concrete pump as set out in the defining portion of patent claim 1.

The pumps for thick matter according to the present invention draw the thick matter from a supply tank and then force the thick matter that has been drawn out of the tank through the distributing regulator and into the delivery line. Even though, in principle, there can be any number of cylinders that perform this delivery function, the present invention relates preferably to two-cylinder concrete pumps in which the delivery cylinders alternate with each other such that every delivery stroke of one cylinder corresponds to a suction stroke of the other cylinder and the delivery and suction strokes of both cylinders are mutually overlapping. The present invention in general, and in particular as embodied herein, does not preclude the fact that the new pump for thick matter, in addition to the delivery cylinders, can also incorporate one or a plurality of so-called compensating cylinders that work in conjunction with the above-discussed delivery cylinders in a pre-determined rythym, in order to bridge over pauses in the delivery process.

Pumps of this kind that are used for thick matter require that the inlet opening of the distributing regulator close off the flow passages for the thick matter in the particular cylinder at the wall of the supply tank that is associated with it, in order to deflect the thick matter into the delivery line under pressure; on the other hand, in this phase, the distributing regulator must release the flow passage for the thick matter in the delivery cylinder to the supply tank, which is to be filled with thick matter from the supply tank by suction ready for the following delivery stroke. In the case of two-cylinder pumps for thick matter this results in a back and forth motion of the distributing regulator between two end positions, during which the inlet opening moves along an arc-shaped path, on the wall of the supply tank, on which the flows of thick matter move from the flow passages for the thick matter and into the delivery line.

Two-cylinder pumps for thick matter are already known; in these, the delivery cylinder openings are identical with the flow passages for the thick matter and for this reason open out directly on the wall of the supply container described above. For this reason, the flow passages for the thick matter are circular. In these thick-matter pumps, the inlet opening of the distributing regulator is also circular and corresponds to the thick matter flow passages, which are identical to each other not only with respect to cross-sectional shape, but also with respect to area. As a result of the distance between the delivery cylinders, which results from design constraints, there is web between these openings on the wall of the supply tank; the inlet opening of the distributing regulator is sealed against this web during its arc-like path between the flow passages for the thick matter. This web is of the smallest possible width. This results from the demand for the smallest space between the delivery cylinders. This demand stems from the practical requirement for small-size thick-matter pumps which, under certain circumstances, when used as concrete pumps, are meant to be installed between the parallel main beams of a truck chassis.

Furthermore, this familiar design has additional advantages. The narrower the web the smaller is the pivoting angle of the distributing regulator. The pivot path that has to be traversed is then short. This means short changeover times and a comparatively small amount of wear on both the moving and the stationary parts. However, it is a disadvantage that the inlet opening of the distributing regulator is not completely covered and sealed off on the narrow web. This results in an open connection between the inlet opening of the distributing regulator and the supply tank during the movement of the distributing regulator into its end positions. This causes a short circuit between the delivery line and the supply tank, which leads to uneven delivery of the thick matter through the delivery line and to degradation of the volumetric efficiency of the pump.

It is known that two cylinder pumps for thick matter can be used to avoid the short-circuits during the pivoting movement that have been described heretofore, and the present invention proceeds from these. In these thick-matter pumps, too, the delivery cylinder openings open out on the wall of the supply tank, so that the flow passage openings for the thick matter are circular, the inlet opening of the distributing regulator having the circular outline and the same area as the flow passages for the thick matter, which are identical to each other. However, the distributing regulator has slide plates on both sides of its inlet opening, and these enlarge the surface of the distributing regulator that moves on the supply tank wall. The changeover of the distributing regulator from one end position into the other takes place after the end of a pump stroke is reached. In a middle switch position, the slide plates described heretofore close the openings of both delivery cylinders, on the one hand, whereas on the other hand, the inlet opening of the distributing regulator is sealed against the surface between the outlet openings of the delivery cylinders. This prevents short circuits.

However, the consequence of this so-called positive covering of the flow passages for the thick matter is a wider web between the outlet openings of the delivery cylinders that corresponds to the delivery cylinder diameters. This means an enlargement of the pivot angle of the distributing regulator, a lengthening of the travel of the distributing regulator, and the concomitant disadvantages of greater wear and longer changeover times.

In contrast to this, the present invention follows another path, the basic concept of which is set out in claim 1. Further features of the present invention are the objects of the secondary claims.

Because of the fact that, according to the present invention, the flows of thick matter run through, at the walls of the supply tank, standoff pipes in which they are distorted, it is possible that the flow passages for the thick matter deviate from the circular form that is imparted to them by the delivery cylinders. Since, according to the present invention, these deviations consist in a reduction of the inside diameter of the flow passages for the thick matter that are formed by the standoff pipes, this results in a narrowing of the web, even given an essentially positive covering, with the reduction in diameter of the distributing regulator inlet opening being matched to the web. This results in a reduced pivot movement with a shorter change-over time. For this reason, the present invention has the advantage that for an essentially positive covering, apart from a reduction in wear and a reduction in the change-over times, it also permits the reduction of the space between the delivery cylinders which, amongst other things, also reduces installation problems encountered in connection with mobile pumps for thick matter.

Preferably, and with the features set out in patent claim 2, it is possible to keep the forces required for the above-discussed deformation of the initially completely clyindrical flow of thick matter from the distributing cylinders on the sections of standoff pipe small. Then, specific lengths, mainly determined by practical tests, on which continuous deformation of the flow of thick matter takes place, will result for each type of thick matter that is to be delivered.

One of the possible cross-sectional shapes of the object is the subject of claim 3. The oval cross-section that is described therein results in a specific symmetry, which has an advantageous effect on the overall construction of the thick matter pump.

Another embodiment of the invention, which is the subject of claim 4, dispenses with parabolic cross-sectional shapes in favour of an outline of the cross-section that is composed of essentially rectilinear and rounded segments. This results in continuous outline shapes that have an advantageous effect on the sealing.

The positive covering is determined from the cross-sectional shape of the openings and from the width of the web if no other measures are taken on the distributing regulator. That is the object of claim 5. However, whereas up to that time, one had proceeded from the fact that the open short circuit can only be avoided by positive covering if the web ensures a complete support for the seal of the inlet opening, because of its dimensions, the fact is that, at least for concrete, this is not necessary, for practical reasons. In actual fact, an open short circuit is also avoided if residual gaps are left between the sealing surface of the inlet opening and the edges of the web, always providing that these residual gaps are no greater than is set out in claim 6. In this way, it becomes possible to further reduce the angle of pivot and changeover time without having to accept these troublesome short circuits.

The rule that is set out above also applies to those embodiments of the present invention that also serve to achieve the positive covering of the means for widening the distributing regulator at the inlet opening, which is addressed in claim 6.

The means required for such embodiments are comparatively simple. They are described, for example, in claim 7.

Figure 2:
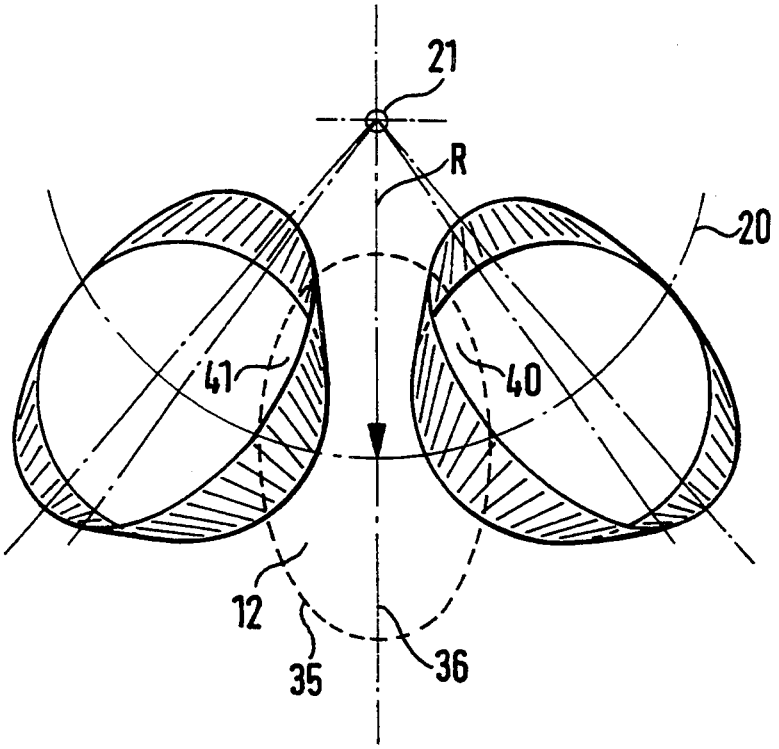
Figure 3:
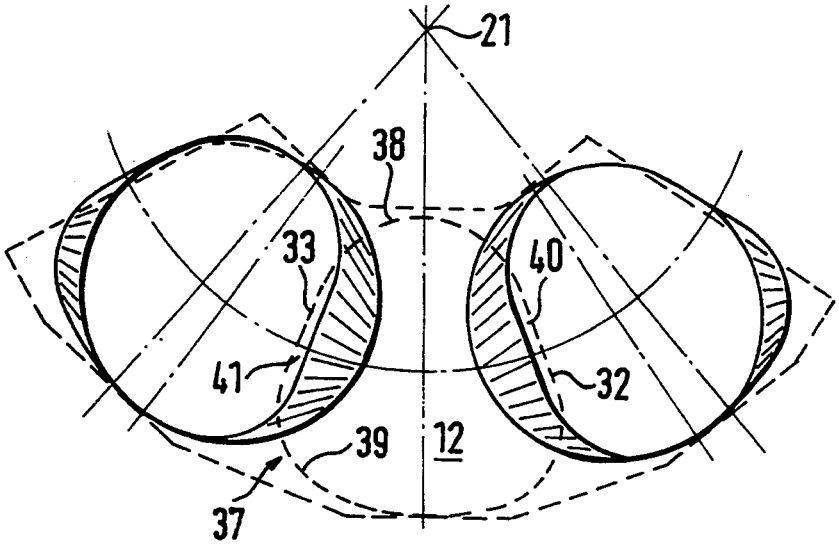
Figure 4:
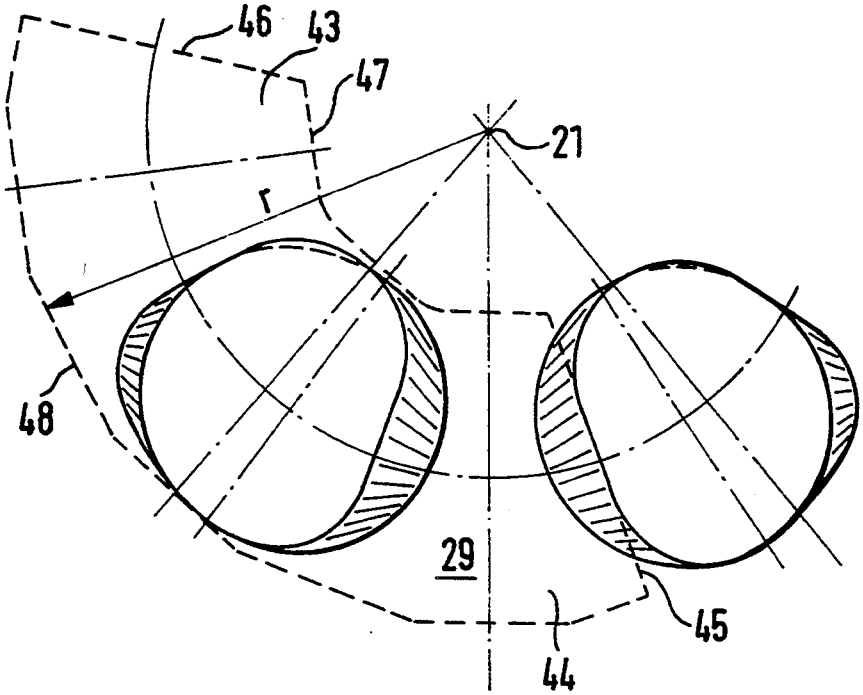
Figure 5:
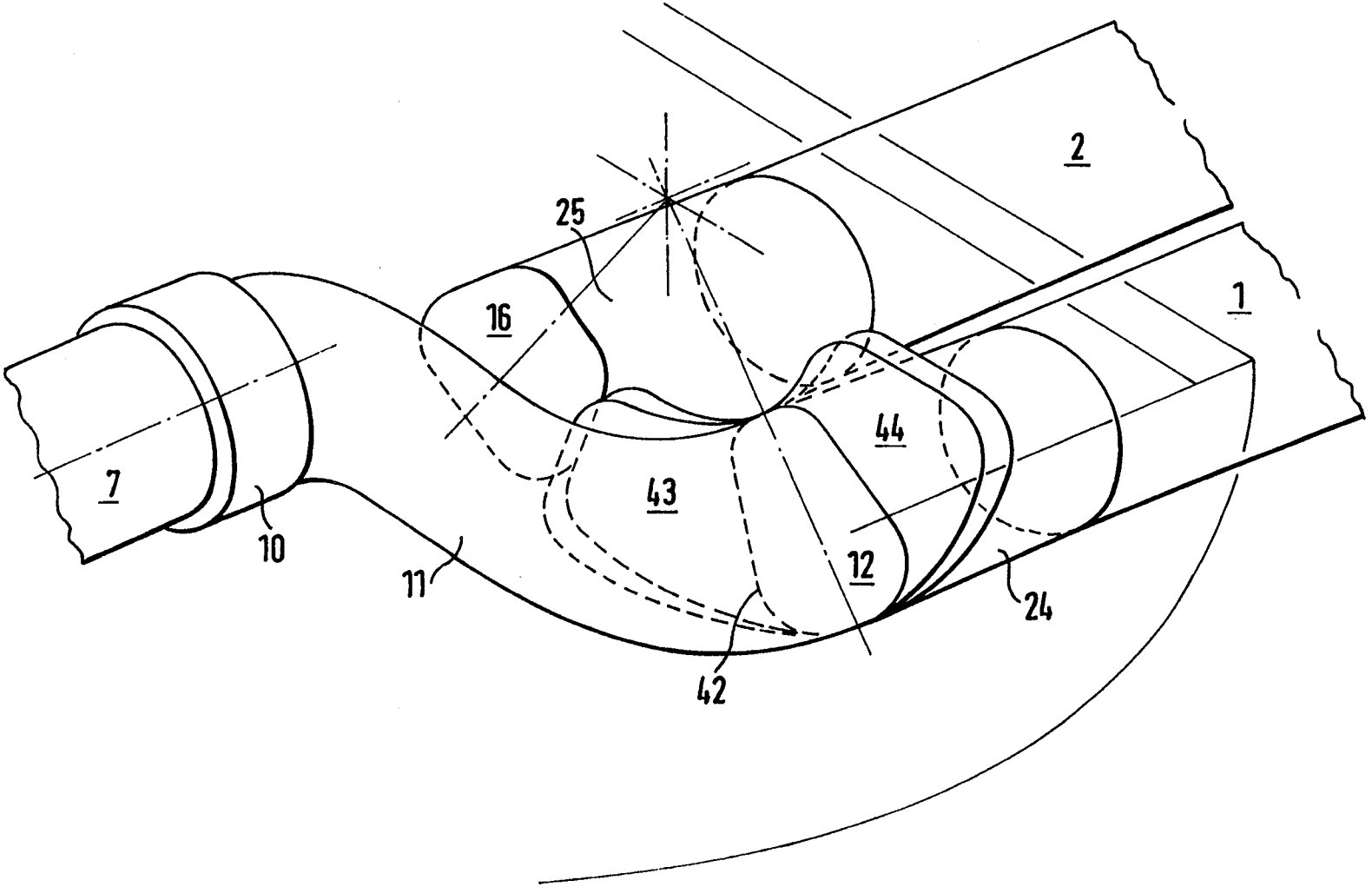

The details, additional features, and other advantages of the present invention are set out in the following description of embodiments, which is based on the drawings appended hereto. These drawings show the following:

FIG. 1: a first embodiment shown in two views, the upper showing the surface transitions of the sections of standoff pipe in the axial direction of the delivery cylinders, and the lower showing a flat projection of the cross-section A-A that follows an arc a-a-;

FIG. 2: another embodiment in an essentially perspective representation of the upper part of FIG. 1;

FIG. 3: a further modified embodiment in an essentially perspective view of the representation shown in FIG. 2;

FIG. 4: the embodiment shown in FIG. 3 in another changeover position;

FIG. 5: a perspective view of the embodiment shown in FIG. 3.

FIG. 1 shows a two-cylinder piston pump that is used for delivering concrete. The two delivery cylinders 1 and 2 have a piston 3 on a piston rod 4 that is used as an expeller. In the phase that is shown, the cylinder 2 delivers the thick matter that has been drawn in previously from a supply tank 6 through its outlet opening 22, as indicated by the arrows, into the delivery line 7. At the same time, the piston (not shown herein) in the cylinder 1 moves in the opposite direction, thereby drawing concrete from the supply tank 6. Once the piston 3 has reached its end position, the direction of the piston changes in the cylinders 1 and 2, when the piston in delivery cylinder 1 forces the concrete into the delivery line 7, whereas the piston 3 in delivery cylinder 2 draws thick matter from the supply tank 6. A distributing regulator 11 determines the particular direction of the flow of thick matter. The outlet opening 8 of the distributing regulator 11 is constantly connected to the pump side end 9 on the delivery line 7 and is located in a rotating pipe connection 10 (FIG. 4). The distributing regulator is a pivoting pipe 11 that is curved into a general S-shape, and it incorporates an inlet opening 12. The inlet opening 12 is surrounded by a seal 14 which seals it against the rear wall 15 of the supply container. The flow passage openings for the thick matter 16, 17 through which the thick matter enters the suction cylinder 1 enters and through which it leaves from the delivery cylinder 2, depending on the direction in which the pistons are moving, open out on this rear wall. In all embodiments of the present invention, the flow passages for the thickness matter 16 and 17 and the inlet opening 12 of the distributing regulator 11 are of identical shape and area. This ensures an undisturbed flow of the thick matter.

As can be seen from the upper drawing in FIG. 1, the midline axes 18, 19 of the delivery cylinders lie on an arc 20 about the centrepoint of rotation 21 of the distributing regulator 11, which is the midpoint of the distributing regulator outlet opening 8. The distance between the delivery cylinder midline axes 18 and 19 corresponds to the angle of arc $\alpha$.

The flow passage openings for the thick matter 16 and 17 are each connected to their associated delivery cylinder openings 22, 23 by a standoff pipe 24, 25. As can be seen from the example of the standoff pipe 25 in the lower drawing in FIG. 1 in its end positions, the distributing regulator 11 lines up with one of the flow passage openings 16, 17 such that the inlet opening 12 of the distributing regulator 11 covers the appropriate flow passage opening 16 or 17. The rotary motion that is required to do this is effected through the angle of arc $\beta$.

Whereas the delivery cylinder openings 22, 23 are of the circular shape 27 that can be seen from the drawing in FIG. 1, the inside diameters of the flow passage openings 16, 17 for the thick matter, which are formed by the standoff pipes 24, 25, are reduced on the web 29. This web results from the spacing between the midline axes 18, 19 of the delivery cylinders 1, 2 and from the flow passage openings 16, 17 for the thick matter on the rear wall 15 of the supply container 6, which are fundamentally dependent on this.

In the upper drawing in FIG. 1, each flow of thick matter is deflected because of the shape of the standoff pipes 24, 25, which diverge from the delivery cylinders 1, 2, so that the points 18, 19 are shifted to the points 30 and 31. In the embodiment shown in FIG. 1 the inside diameter is reduced to the point that the outline lines 331, 332 of the flow passage openings 16, 17 are flattened at points 31 and 32 on the web. This reduction of diameter also occurs with respect to the distributing regulator inlet opening 12 on the web. Because of this, the flattened areas 32, 33 of the web edges coincide with the flattened areas of the distributing regulator inlet opening 12.

In the embodiment shown in FIG. 2, the distributing regulator inlet opening 35 is indicated by the dashed line 35. This corresponds to an oval cross-section, of which the longer cross-sectional axis 36 lies on a radius R that is described about the rotational midpoint 21. The shorter axis intersects the arc 20 as a secant, and for this reason also lies on the web. In the embodiments shown in FIGS. 1 and 2, the value of the area of the web 29 between the thick matter flow passage openings 16 and 17 of the standoff pipe sections 24 and 25 with their cross-section is identical to the thick-matter flow passage openings 16 and 17.

The length of the standoff pipe sections 24, 25 is such that optimization of the distortion resistance of the thick matter from the circular cross-sectional shape 27, 28 of the delivery cylinders 1 and 2 to the outline shape 331, 321 of the thick-matter flow passage openings 16 and 17 takes place. In the embodiment shown in FIG. 1 the area of the thick-matter flow passage openings 16, 17 is essentially the same as that of the delivery cylinders 1, 2, although this is not a prerequisite.

In the embodiment shown in FIG. 3 the outline shape of the openings 16, 17 or 12, respectively, is selected using the example of the opening 12 according to the dashed line 37. The reduction in diameter on the web once again leads to a reduction of the diameter, in the example to a flattening of the outline, which is shown at 32 and 33. These flattened areas lie essentially in the direction of a radius r that is described about the rotational midpoint 21. The two flattened areas 32, 33 are essentially connected by arcs 38, 39 that are curved towards the radii. In addition, the size of the web area is reduced such that gaps 40, 41 are formed when the distributing regulator 11 is in the mid-position, and these result in negative cover. Such gaps also occur in the embodiment shown in FIG. 2, where they are similarly numbered 40 and 41. These gaps are such that their maximal size is in the order of half the median grain size of the thick matter.

In the embodiment shown in FIG. 5, an identical outline 42 for the distributing regulator inlet opening 12, or one that corresponds to the outline shape of the embodiment in FIG. 3, has been selected. However, on both sides of the opening 12, the distributing regulator has wider sections in the form of regulating distributor side plates 43, 44. Because of this, it is possible that in the end position shown of the distributing regulator 11, the plate 43 will open the thick matter flow passage opening 16 of the standoff pipe 25 on the delivery cylinder 2 when the opening 12 covers the flow passage opening 17 of the standoff pipe 24 on the delivery cylinder 1.

As can be seen from FIG. 4, the gaps described heretofore are avoided by this. As can be seen from a comparison of FIGS. 3 and 4, in each instance the shorter edge of the essentially arc-shaped regulating distributor plate arrangement 43, 44 lines up in the end position of the distributing regulator with the flattened areas 32, 33. Then, in the drawing in FIG. 4, the distributing regulator plate 44 covers the whole web 29 in the end position of the distributing regulator that is shown on the left. In the other state, this positive cover is effected with the distributing regulator plate 43. The shorter edges of the distributing regulator plates 43, 44 are numbered 45 and 46 in FIG. 4. The longer and essentially parallel edges 47, 48 are generally seen arranged at a radius r about the rotational midpoint 21 of the slide 7. In the embodiment shown, this curve has been replaced by a polygonal line, in order to reduce excess area of the regulating distributor and thereby minimize the mass of the distributing regulator.

I claim:

1. In a two cylinder pivoting valve thick matter pump in which a valve pivots between a first position in which a first cylinder is connected by the valve to an outlet and a second cylinder is open to a hopper and a second position in which the second cylinder is connected to the outlet by the valve and the first cylinder is open to the hopper, characterized in that a first flow passage connects the first cylinder to the hopper and a second flow passage connects the second cylinder to the hopper, the first and second flow passages having openings at the hopper, the flow passage openings at the hopper and an opening at a first end of the valve being similarly shaped in cross-sectional area to selectively connect the first and second cylinders to the outlet, the flow passages being shaped differently from the first and second cylinders so that the flow passage openings have a different cross-sectional shape than the cylinders such that the shape of a web region defined between the openings of the first and second flow passages at the hopper minimizes simultaneous overlap of the openings of the first and second flow passages and the opening at the first end of the valve during movement of the first end of the valve between the first and second positions.

2. The pump of claim 1 wherein the length of the first and second flow passages is defined to provide minimum deformation resistance of thick matter through the first and second flow passages.

3. The pump of claim 1 wherein the shape of the flow passages is defined such that the flow passage openings are oval shaped.

4. The pump of claim 1 wherein the valve rotates about an axis and the first and second flow passages have a top section and a bottom section wherein the top sections of the flow passages are closer to the axis of rotation of the valve than the bottom sections of the flow passages and the shape of the flow passages are defined such that the flow passage openings are wider at the bottom sections of the flow passages than at the top sections of the flow passages.

5. The pump of claim 1 wherein the shape of the flow passage openings are defined such that the maximum size of gaps formed by the simultaneous overlap of the opening of the first end of the valve and the openings of the first and second flow passages when the valve is at a mid-position between the first and second positions has a magnitude of approximately half the median grain size of the thick matter.

6. The pump of claim 1 wherein the valve includes a seal at the first end.

7. The pump of claim 6 wherein the seal is formed of opposed side plates at the opening of the first end of the valve and the side plates being sized to provide positive cover of the first and second flow passage openings during movement of the valve between the first and second positions.

8. The pump of claim 7 wherein the side plates are essentially curvedly shaped.

9. The pump of claim 7 wherein the side plates are shaped to provide maximum cover with minimum area to reduce the weight of the valve.

* * * * *

UNITED STATES PATENT AND TRADEMARK OFFICE

CERTIFICATE OF CORRECTION

PATENT NO. : 5,380,174

DATED : January 10, 1995

INVENTOR(S) : Friedrich Schwing

It is certified that error appears in the above-indentified patent and that said Letters Patent is hereby corrected as shown below:

On the Title Page of the Patent, delete [57] ABSTRACT, insert

[57] ABSTRACT

A pump for thick matter having dual delivery cylinder (1, 2). The thick matter pump including a valve (11) operably connected to pivot between the delivery cylinders (1,2) to selectively connect the delivery cylinders (1,2) to a delivery line (7) connected to the valve (11). The pump including a hopper (6). The delivery cylinders (1,2) being operably connected to the hopper to selectively intake thick matter for delivery to the delivery line (7) through valve (11). Delivery cylinders (1,2) being operably connected to the hopper through standoff pipes (22,25) to define flow passages having flow passage openings (16,17) at the hopper. The shape of the standoff pipes (24,25) being formed differently from the delivery cylinders (1,2) such that the web region (29) defined between the flow passage openings (16,17) at the hopper (6) provides minimum simultaneous overlap of the openings of the first and second flow passages (16,17) and the inlet to the valve (12) as valve (11) moves between its first and second end positions to selectively connect the delivery cylinders (1,2) to the delivery line (7).

Col. 1, line 14, after "distributing regulator", insert --or valve--

Col. 1, lines 32-33, after "distributing regulator", insert --or valve--

UNITED STATES PATENT AND TRADEMARK OFFICE

CERTIFICATE OF CORRECTION

PATENT NO. : 5,380,174

DATED : January 10, 1995

INVENTOR(S) : Friedrich Schwing

It is certified that error appears in the above-indentified patent and that said Letters Patent is hereby corrected as shown below:

Col. 3, line 7, after "Preferably,", delete "and with the features set out in patent claim 2,"

Col. 3, lines 17-18, delete "the subject of claim 3. The oval cross-section that is described therein", insert --an oval cross-section which--

Col. 3, lines 21-22, delete "which is the subject of claim 4."

Col. 3, line 23, delete "favour", insert --favor--

Col. 3, line 25, after "segments", insert --as shown in figure 3--

Col. 3, line 30, delete "That is the object of claim 5."

Col. 3, delete lines 44-51.

Col. 3, after line 56, insert --BRIEF DESCRIPTION OF THE DRAWINGS--

Col. 4, after line 2, insert --DETAILED DESCRIPTION OF THE PREFERRED EMBODIMENTS--

Col. 4, line 3, after "piston pump", insert --100--

Col. 4, line 8, after "supply tank", insert --or hopper--

Col. 4, line 8, delete "its", insert --an--

Col. 4, line 9, delete "22", insert --23--

Col. 4, line 9, delete "the delivery", insert --a delivery--

UNITED STATES PATENT AND TRADEMARK OFFICE

CERTIFICATE OF CORRECTION

PATENT NO. : 5,380,174

DATED : January 10, 1995

INVENTOR(S) : Friedrich Schwing

It is certified that error appears in the above-indentified patent and that said Letters Patent is hereby corrected as shown below:

Col. 4, line 12, after "supply tank", insert --or hopper--

Col. 4, line 14, delete "piston changes", insert --pistons change--

Col. 4, line 14, delete "1 and 2, when", insert --1 and 2. Then--

Col. 4, line 17, after "supply tank", insert --or hopper--

Col. 4, line 18, after "regulator", insert --or valve--

Col. 4, lines 18-19, delete "determines the particular direction of the flow of thick matter", insert --selectively connects cylinders 1 and 2 to the delivery line 7--

Col. 4, line 19, delete "The", insert --An--

Col. 4, line 20, after "regulator", insert --or valve--

Col. 4, line 21, after "end 9", delete "on", insert --of--

Col. 4, line 21, delete "located in", insert --connected by--

Col. 4, line 22, delete "(FIG. 4)", insert --(FIGS. 1 and 5)--

Col. 4, line 23, after "regulator", insert --or valve--

Col. 4, line 24, after "opening 12", insert --at a first end of the valve 11--

Col. 4, line 25, after "seal 14", insert --as shown in FIG. 1--

Col. 4, line 26, delete "seals it", insert --seals the inlet opening 12 to the valve 11--

Col. 4, line 26, delete "container", insert --tank or hopper 6--

UNITED STATES PATENT AND TRADEMARK OFFICE

CERTIFICATE OF CORRECTION

PATENT NO. : 5,380,174

DATED : January 10, 1995

INVENTOR(S) : Friedrich Schwing

It is certified that error appears in the above-indentified patent and that said Letters Patent is hereby corrected as shown below:

Col. 4, line 27, delete "The flow passage openings for the thick matter 16, 17 through which the thick matter enters the suction cylinder 1 enters and through which it leaves from the deliver cylinder 2, depending on the direction in which the pistons are moving, oepn out on this rear wall", insert --Flow passage 24 and 25 selectively connect the first and second cylinders 1 and 2 to the valve 11 through flow passage openings 16 and 17--

Col. 4, line 32, delete "flow passages", insert --flow passage openings--

Col. 4, line 33, delete "thickness", insert --thick--

Col. 4, line 34, after "regulator", insert --or valve--

Col. 4, line 38, after "delivery cylinders", insert --1 and 2--

Col. 4, line 39, delete "centrepoint", insert --centerpoint--

Col. 4, line 40, after "regulator", insert --or valve--

Col. 4, line 41, after "regulator", insert --or valve 11--

Col. 4, line 42, delete "cylinder", insert --cylinders 1 and 2--

UNITED STATES PATENT AND TRADEMARK OFFICE

CERTIFICATE OF CORRECTION

PATENT NO. : 5,380,174

DATED : January 10, 1995

INVENTOR(S) : Friedrich Schwing

It is certified that error appears in the above-indentified patent and that said Letters Patent is hereby corrected as shown below:

Col. 4, lines 44-46, delete "The flow passage openings for the the thick matter 16 and 17 are each connected to their associated delivery cylinder openings 22, 23 by a standoff pipe 24, 25.", insert --Flow passages 24 and 25 connecting the first and second cylinders 1 and 2 to the hopper 6 are formed by standoff pipes 224 and 225.--

Col. 4, line 47, delete "of the standoff pipe 25"

Col. 4, line 48, delete "in its end positions"

Col. 4, line 49, after "regulator", insert --or valve--

Col. 4, line 49, after "11", insert --pivots between a first end position and a second end position, in the first end position the opening 12 to valve 11--

Col. 4, line 49, delete "one of the"

Col. 4, line 50, delete "openings", insert --opening--

Col. 4, line 50, after "16," insert —and in the second end position, the opening 12 to valve 11 lines up with flow passage opening--

Col. 4, lines 50-52, delete "such that the inlet opening 12 of the distributing regulator 11 covers the appropriate flow passage opening 16 or 17"

Col. 4, line 52, after "rotary motion", insert --of the valve 11--

Col. 4, lines 52-53, delete "that is required to do this"

UNITED STATES PATENT AND TRADEMARK OFFICE

CERTIFICATE OF CORRECTION

PATENT NO. : 5,380,174

DATED : January 10, 1995

INVENTOR(S) : Friedrich Schwing

It is certified that error appears in the above-indentified patent and that said Letters Patent is hereby corrected as shown below:

Col. 4, line 54, after "β", insert --defining the rotational travel of the valve 11 between the first and second end positions. A web region 29 is defined by the extend of the hopper 6 between the flow passage openings 16 and 17. The shape of the stand off pipes 24 and 25 is designed so that the extent of the web region 29 and the shape of the flow passage openings 16 and 17 defined thereby restricts simultaneous overlap between the inlet opening 12 of the valve 11 and the flow passage openings 16 and 17 during operation of the valve 11 between the first and second end positions.--

Col. 4, line 56, delete "the circular", insert --circular--

Col. 4, line 57, delete "inside diameters of the"

Col. 4, line 58, delete "16, 17", insert --16 and 17--

Col. 4, lines 59-64, delete "reduced on the web 29. This web results from the spacing between the midline axes 18, 19 of the delivery cylinders 1, 2 and from the flow passage openings 16, 17 for the thick matter on the rear wall 15 of the supply container 6, which are fundamentally dependent on this.--, insert --shaped such that flow passage openings 16 and 17 are sized smaller at a top 200 of the flow passage opening 16 or 17 than at a bottom 202 of the flow passage opening 16 or 17.--

Col. 4, line 65, delete "each"

UNITED STATES PATENT AND TRADEMARK OFFICE

CERTIFICATE OF CORRECTION

PATENT NO. : 5,380,174

DATED : January 10, 1995

INVENTOR(S) : Friedrich Schwing

It is certified that error appears in the above-indentified patent and that said Letters Patent is hereby corrected as shown below:

Col. 4, line 68. delete ".so that the points 18, 19 are shifted to the points 30--

Col. 5, line 1, delete "and 31.", insert --The shape of the flow passage openings 16 and 17 shown in FIG. 1, have inner surfaces 32 and 33 adjacent the web region 29. The inner surfaces 32 and 33 of the respective flow passage openings 16 and 17 are spaced a greater rotational distance apart about the rotational axis 21 than the openings 22 and 23 of the cylinders 1 and 2. The shape of the flow passage openings 16 and 17 is outlined (321 and 331) as shown in FIG. 1. The shape of the inlet 12 to the valve 11 is similar to and coincides with the shape of the flow passage openings 16 and 17.--

Col. 5, lines 1-6, delete "In the embodiment shown in FIG. 1 the inside diameter is reduced to the point that the outline lines 331, 332 of the flow passage openings 16, 17 are flattened at points 31 and 32 on the web. This reduction of diameter also occurs with respect to the distributing regulator inlet opening 12 on the web."

Col. 5, line 7, after "web edges", insert --of the openings 16 and 17--

Col. 5, line 8, delete "distributing regulator", insert --valve--

Col. 5, line 10, delete "In the embodiment", insert --In a second embodiment--

UNITED STATES PATENT AND TRADEMARK OFFICE

CERTIFICATE OF CORRECTION

PATENT NO. : 5,380,174

DATED : January 10, 1995

INVENTOR(S) : Friedrich Schwing

It is certified that error appears in the above-indentified patent and that said Letters Patent is hereby corrected as shown below:

Col. 5, line 11, after "regulator", insert --or valve--

Col. 5, line 11, delete "35", insert --12--

Col. 5, line 14, after "midpoint 21", insert --of valve 11--

Col. 5, line 15. after "secant", delete ", and for this reason also lies on the web"

Col. 5, line 17, delete --value of the area of the web 29", insert --web region 29 of the hopper 6--

Col. 5, lines 19-20, delete "with their cross-section is identical to", insert --coincides with the area of--

Col. 5, lines 21, after "16 and 17", insert --and inlet opening 12 to the valve 11 to provide minimum simultaneous overlap between the inlet opening 12 to the valve 11 and the first and second flow passage openings 16 and 17 during operation of the valve 11 between its end positions, in its mid-position.--

Col. 5, line 24, after "27, 28", insert --(FIG. 1)--

Col. 5, lines 25-26, delete "outline shape 331, 321 of the"

Col. 5, delete lines 31-48, insert --In the embodiment shown in FIG. 3, the outline shape of the openings 16, 17 or 12, respectively, is selected using the example of the opening 12 according to the dashed line 37.

UNITED STATES PATENT AND TRADEMARK OFFICE

CERTIFICATE OF CORRECTION

PATENT NO. : 5,380,174

DATED : January 10, 1995

INVENTOR(S) : Friedrich Schwing

It is certified that error appears in the above-indentified patent and that said Letters Patent is hereby corrected as shown below:

The shape of the flow passage openings 16, 17 and inlet 12 as shown include flattened edges 34A and 34B and the flattened edges 34A and 34B are essentially connected by arcs 38, 39 that are curved towards the radii.

The shape and position of the flow passages openings 16 and 17 and the inlet 12 to the valve 11 may be designed such that the size of the web region 29 is reduced such that gaps 40, 41 are formed when the distributing regulator or valve 11 is in the mid-position between the first and second end positions, and this results in negative cover as shown in FIGS. 2 and 3. These gaps are such that their maximal size is in the order of half the median grain size of the thick matter.--

Col. 5, line 49, delete "an identical"

Col. 5, line 50, after "42", delete "for", insert --illustrates the shape of--

Col. 5, line 50, after "regulator", insert --or valve--

Col. 5, lines 50-51, delete ", or one"

Col. 5, line 52, delete ",has been selected"

Col. 5, line 52, delete "However," insert —As shown in FIGS. 3-5,—

Col. 5, line 53, after "regulator", insert --or valve 11--

Col. 5, line 54, delete "has", insert --includes--

Col. 5, line 55, delete "43, 44" insert —43 and 44—

UNITED STATES PATENT AND TRADEMARK OFFICE

CERTIFICATE OF CORRECTION

PATENT NO. : 5,380,174

DATED : January 10, 1995

INVENTOR(S) : Friedrich Schwing

It is certified that error appears in the above-indentified patent and that said Letters Patent is hereby corrected as shown below:

Col. 5, line 56, delete --shown--

Col. 5, line 56, after "regulator", insert --or valve--

Col. 5, line 56, after "11", insert --shown in FIG. 5--

Col. 5, line 58, delete "opening 16", insert --opening 17--

Col. 5, lines 58-59, after "cylinder 2", insert --to the hopper 6--

Col. 5, line 59, after "opening 12", insert --of the valve 11--

Col. 5, line 60, delete "opening 17", insert --opening 16--

Col. 5, lines 60-61, after "pipe 24", delete --on the delivery cylinder 1--

Col. 5, line 63, delete "by this", insert --by side plates 43 and 44--

Col. 5, line 66, delete "43, 44", insert --43 and 44--

Col. 5, line 66, delete "end position", insert --end and mid-positions--

Col. 5, line 67, after "regulator", insert --or valve 11--

Col. 5, line 67, delete "areas 32, 33", insert --areas 34A or 34B--

UNITED STATES PATENT AND TRADEMARK OFFICE

CERTIFICATE OF CORRECTION

PATENT NO. : 5,380,174

DATED : January 10, 1995

INVENTOR(S) : Friedrich Schwing

It is certified that error appears in the above-indentified patent and that said Letters Patent is hereby corrected as shown below:

Col. 5, line 69, delete "web 29", insert --web region 29--

Col. 5, line 70, after "regulator", insert --or valve 11--

Col. 6, line 1, after "plate 43", insert --in FIG. 5--

Col. 6, line 5, delete "slide 7", insert --valve 11--

Col. 6, lines 8-9, delete "distributing regulator", insert --valve 11--

Signed and Sealed this

Twenty-seventh Day of June, 1995

*Attest:*

Bruce Lehman

BRUCE LEHMAN

*Attesting Officer*

*Commissioner of Patents and Trademarks*